US006928899B1

(12) United States Patent
Lin

(10) Patent No.: US 6,928,899 B1
(45) Date of Patent: Aug. 16, 2005

(54) STRIKING HEAD-INTERCHANGEABLE HAMMER WITH A STRESS-DISTRIBUTABLE FASTENER

(76) Inventor: Ming-Hsuan Lin, No. 29-2, Sec. 1, Tafeng Road, Tantzu Hsiang, Taichung Hsien (TW)

( * ) Notice: Subject to any disclaimer, the term of this patent is extended or adjusted under 35 U.S.C. 154(b) by 0 days.

(21) Appl. No.: 10/844,669

(22) Filed: May 12, 2004

(51) Int. Cl.[7] ..... B25D 1/02
(52) U.S. Cl. ..... 81/25; 81/20; 81/21
(58) Field of Search ..... 81/25, 20, 21, 81/22

(56) References Cited

U.S. PATENT DOCUMENTS 722,899 A * 3/1903 Reeder ..... 81/20
1,297,386 A * 3/1919 Michki ..... 81/25
3,130,762 A * 4/1964 Kerr ..... 81/25
4,039,012 A * 8/1977 Cook ..... 81/22
4,924,576 A * 5/1990 Schiller ..... 30/358
6,347,562 B1 * 2/2002 Gerber, Jr. ..... 81/25

* cited by examiner

*Primary Examiner*—Joseph J. Hail, III
*Assistant Examiner*—Alvin J Grant
(74) *Attorney, Agent, or Firm*—Jonathan Alan Quine; Quine Intellectual Property Law Group, P.C.

(57) ABSTRACT

A striking head-interchangeable hammer includes a handle, a head body connected securely to the handle and formed with a through-hole and upper and lower bores, a striking body having a connecting portion that is received fittingly in the lower bore, and a stress-distributable fastener including a connecting rod that extends through the through-hole and the upper and lower bores in the head body to engage threadedly the striking body, and that is formed with an abutting flange received fittingly in the upper bore and anchored on and abutting against an abutting face of a bore-defining wall of the upper bore upon tightening of the connecting rod onto the striking body.

7 Claims, 4 Drawing Sheets

STRIKING HEAD-INTERCHANGEABLE HAMMER WITH A STRESS-DISTRIBUTABLE FASTENER

BACKGROUND OF THE INVENTION

1. Field of the Invention

This invention relates to a striking head-interchangeable hammer, more particularly to a striking head-interchangeable hammer with a stress-distributable fastener.

2. Description of the Related Art

U.S. Pat. No. 6,655,236 discloses a conventional hammer device with interchangeable head members. The hammer device includes a handle, a head body with a threaded rod, and a plurality of striking head members, each of which has an inner thread that is threadedly engageable with the threaded rod of the head body. A counterforce acting on the striking head member on the head body is generated during a hammering operation of the hammer device. The counterforce pulls the striking head member away from the head body, and results in a stress concentrated on the threaded rod of the head body and the inner thread of the striking head member, which can cause loosening of the striking head member and damage to the threaded rod and the striking head member.

SUMMARY OF THE INVENTION

The object of the present invention is to provide a striking head-interchangeable hammer that is capable of overcoming the aforesaid drawbacks associated with the prior art.

According to this invention, a striking head-interchangeable hammer comprises: a handle; a head body connected securely to the handle, having opposite upper and lower ends, and formed with a through-hole that extends between the upper and lower ends, an upper bore that is larger in diameter than and that extends from the through-hole to the upper end of the head body, and a lower bore that is opposite to the upper bore and that is larger in diameter than and that extends from the through-hole to the lower end of the head body, the upper bore being defined by a bore-defining wall that defines a first abutting face transverse to the length of the through-hole; a striking body mounted detachably on the lower end of the head body and having a striking portion and a connecting portion that extends from the striking portion, that is received fittingly in the lower bore in the head body, and that is formed with an inner thread; and a stress-distributable fastener including a connecting rod that extends fittingly through the through-hole and the upper and lower bores in the head body and that has a threaded lower end which engages threadedly the inner thread of the connecting portion of the striking body, and an upper end which is opposite to the threaded lower end and which is formed with an abutting flange extending radially and outwardly therefrom. The abutting flange is received fittingly in the upper bore, and defines a second abutting face that is anchored on and that abuts against the first abutting face of the bore-defining wall of the upper bore upon tightening of the threaded lower end of the connecting rod onto the inner thread of the connecting portion of the striking body so as to distribute stress, which results from a hammering operation, to the abutting flange, and so as to prevent concentration of the stress on the threaded lower end of the connecting rod and loosening of the striking body from the head body.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
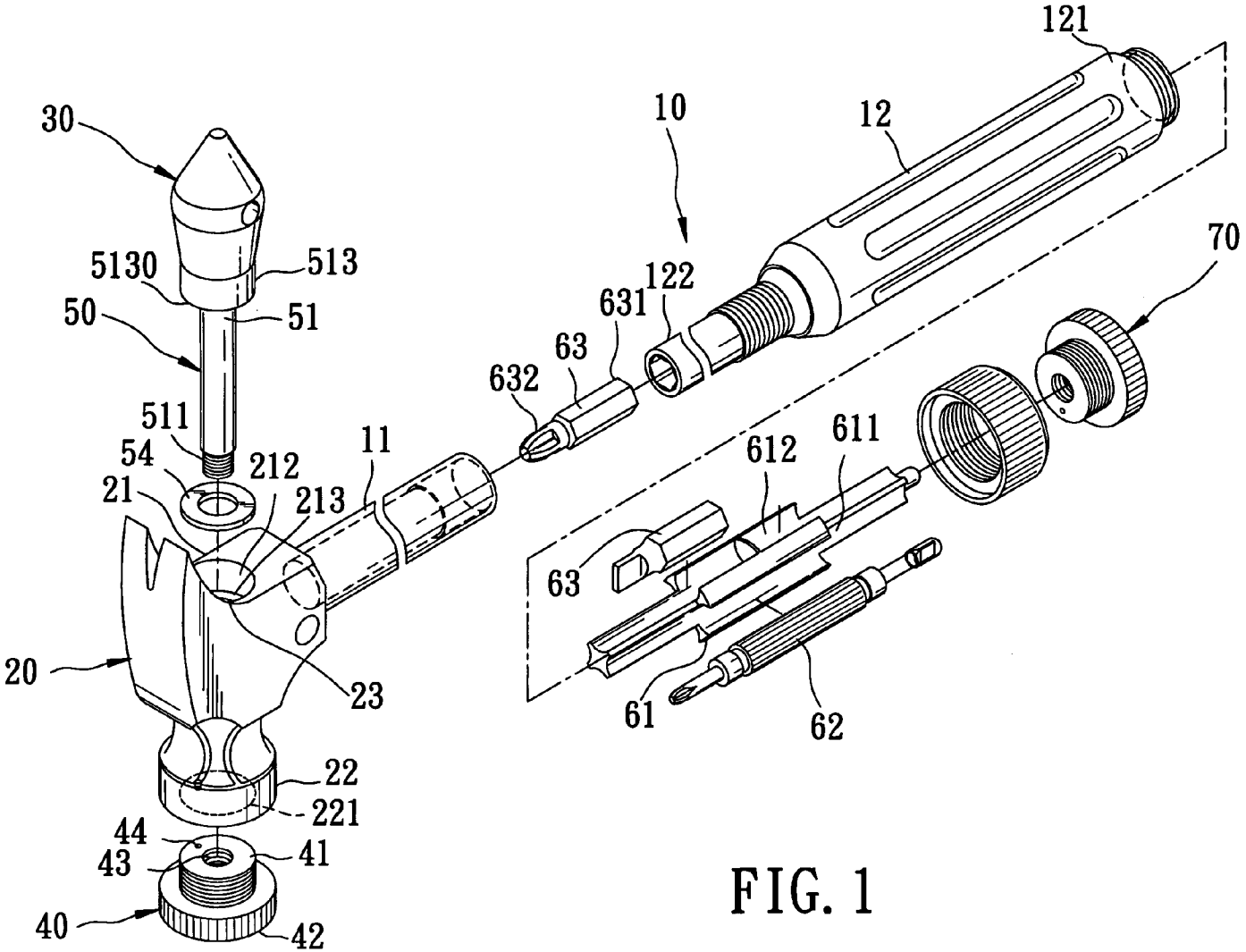
FIG. 1 is an exploded perspective view of the preferred embodiment of a striking head-interchangeable hammer according to this invention.
Figure 2:
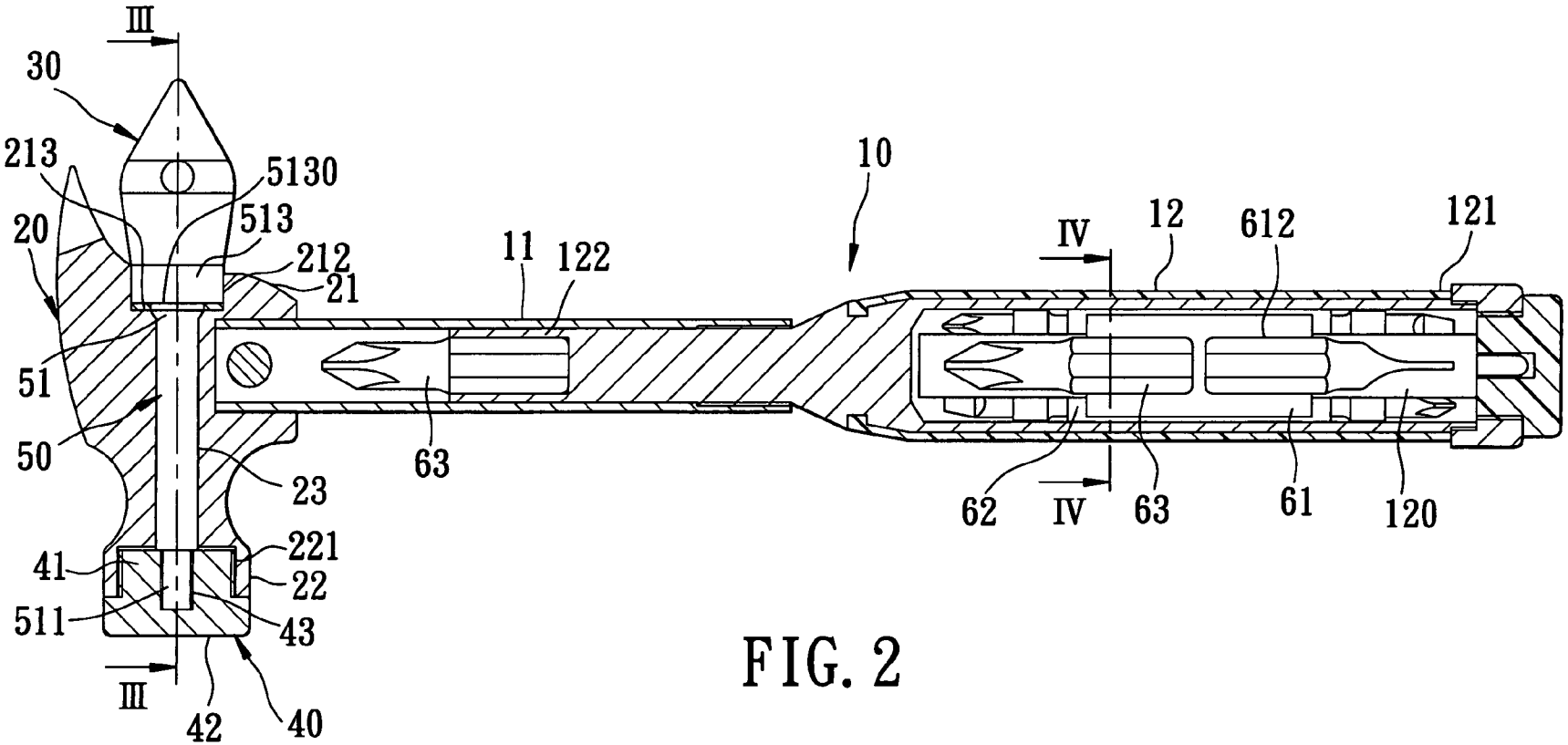
FIG. 2 is a sectional view of the preferred embodiment.

FIGS. 1 to 4 illustrate the preferred embodiment of a striking head-interchangeable hammer according to this invention.

The striking head-interchangeable hammer includes: a handle 10; a head body 20 connected securely to the handle 10, having opposite upper and lower ends 21, 22, and formed with a through-hole 23 that extends between the upper and lower ends 21, 22, an upper bore 212 that is larger in diameter than and that extends from the through-hole 23 to the upper end 21 of the head body 20, and a lower bore 221 that is opposite to the upper bore 212 and that is larger in diameter than and that extends from the through-hole 23 to the lower end 22 of the head body 20, the upper bore 212 being defined by a bore-defining wall that defines a first abutting face 213 transverse to the length of the through-hole 23; a first striking body 40 mounted detachably on the lower end 22 of the head body 20 and having a striking portion 42 and a connecting portion 41 that extends from the striking portion 42, that is received fittingly in the lower bore 221 in the head body 20, and that is formed with an inner thread 43; and a stress-distributable fastener 50 including a connecting rod 51 that extends fittingly through the through-hole 23 and the upper and lower bores 212, 221 in the head body 20 and that has a threaded lower end 511 which engages threadedly the inner thread 43 of the connecting portion 41 of the first striking body 40, and an upper end which is opposite to the threaded lower end 511 and which is formed with an abutting flange 513 extending radially and outwardly therefrom. The abutting flange 513 is received fittingly in the upper bore 212, and defines a second abutting face 5130 that is anchored on and that abuts against the first abutting face 213 of the bore-defining wall of the upper bore 212 through a washer 54 upon tightening of the threaded lower end 511 of the connecting rod 51 onto the inner thread 43 of the connecting portion 41 of the first striking body 40 so as to distribute stress, which results from a hammering operation, to the abutting flange 513, and so as to prevent concentration of the stress on the threaded lower end 511 of the connecting rod 51 and loosening of the first striking body 40 from the head body 20.

In this embodiment, a second striking body 30 is disposed opposite to the first striking body 40, and is integrally formed with and extends from the abutting flange 513 of the stress-distributable fastener 50.

Figure 3:
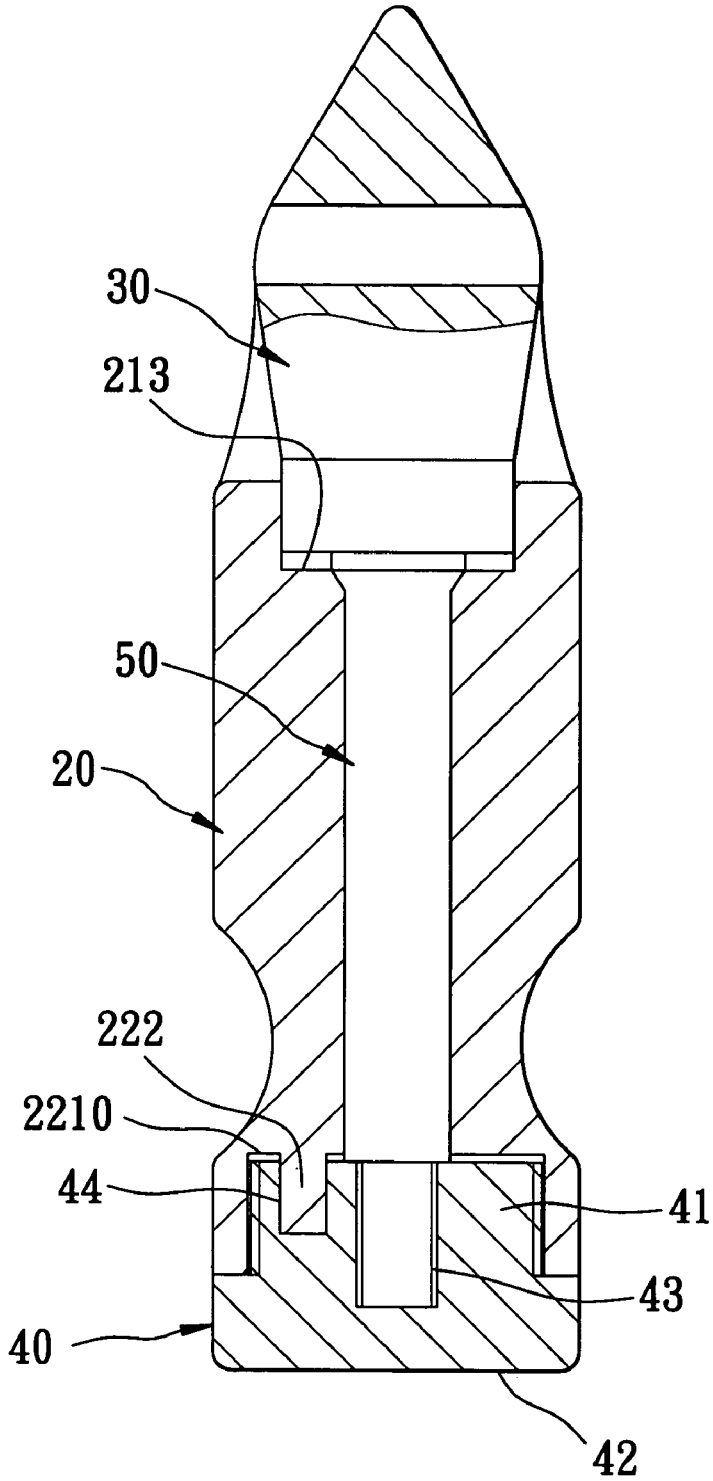
FIG. 3 is a sectional view taken along lines m—m in FIG. 2.
Figure 4:
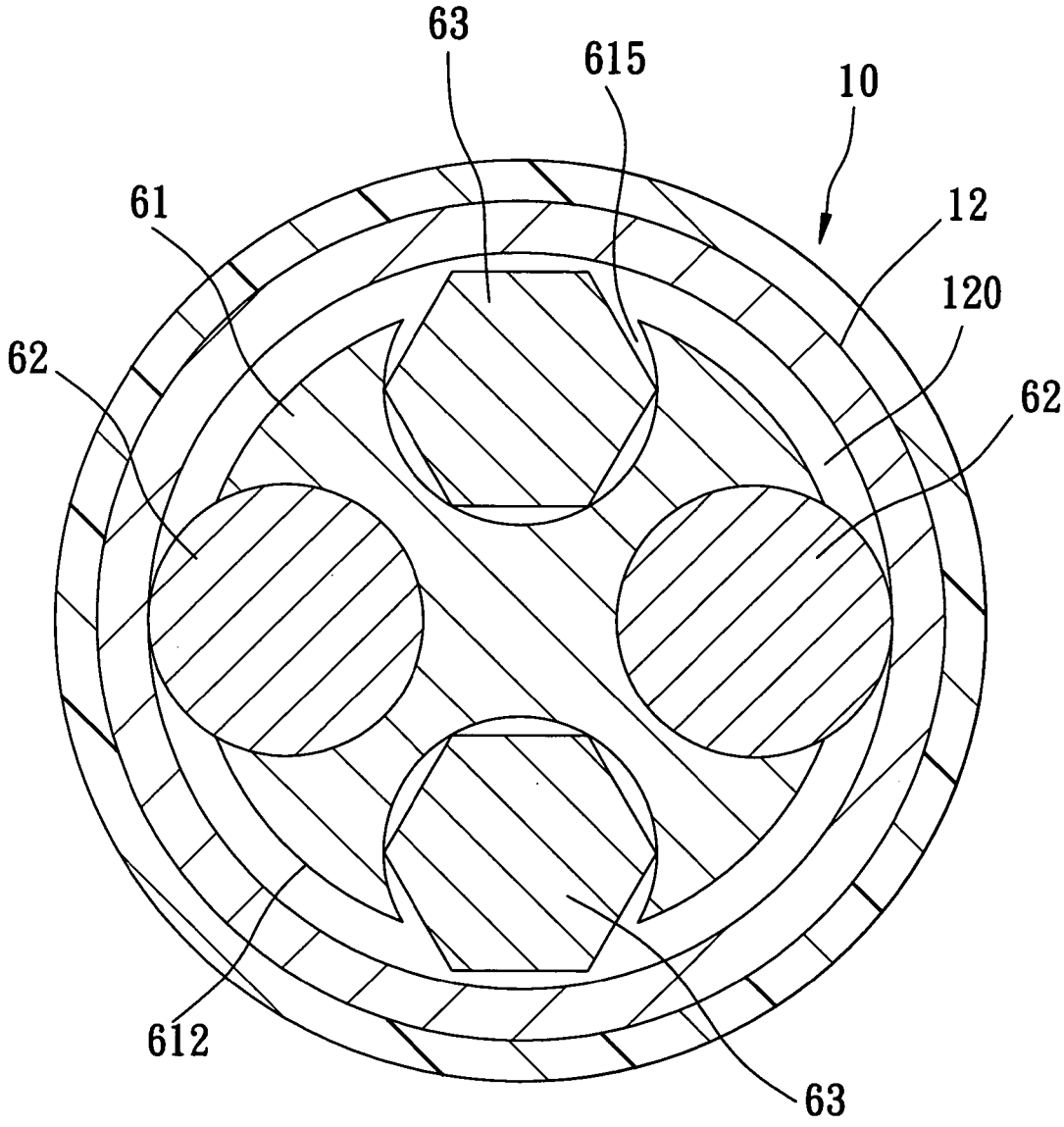
FIG. 4 is a sectional view taken along lines IV—IV in FIG. 2.

Referring now to FIG. 3, the lower bore 221 in the head body 20 is defined by a bore-defining wall that defines a base face 2210 opposite to the first abutting face 213 of the bore-defining wall of the upper bore 212. The head body 20 is formed with a positioning pin 222 that protrudes from the base face 2210 into the lower bore 221. The connecting portion 41 of the first striking body 40 is formed with a pin hole 44 that receives fittingly the positioning pin 222 therein. The handle 10 includes a first tubular member 11 that is connected securely to the head body 20, and a second tubular member 12 that has a socket end 122 extending into and connected securely and detachably to the first tubular member 11. A screw-driving bit 63 has a non-circular connecting end 631 that is snugly fitted in the socket end 122 of the second tubular member 12, and a driving end 632 that is opposite to the connecting end 631 and that extends into the first tubular member 11 when the first and second tubular members 11, 12 are assembled together. A third striking body 70 is mounted detachably on a free end 121 of the second tubular member 12 of the handle 10, and is interchangeable with the first striking body 40 for mounting on the head body 20.

The second tubular member 12 defines an inner space 120 therein. An elongated bit-positioning member 61 is received in the inner space 120 in the second tubular member 12, and includes a central rod 611 and a plurality of angularly displaced partitioning fins 612 extending radially from the central rod 611 so as to divide the inner space 120 into a plurality of partitions 615 (see FIG. 4) that are adapted to receive tool bits 63, 62 therein, respectively.

With the inclusion of the stress-distributable fastener 50 in the striking head-interchangeable hammer of this invention, the aforesaid drawbacks associated with the prior art can be obviated.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A striking head-interchangeable hammer comprising:

a handle;

a head body connected securely to said handle, having opposite upper and lower ends, and formed with a through-hole that extends between said upper and lower ends, an upper bore that extends from said through-hole to said upper end of said head body, and a lower bore that is opposite to said upper bore and that extends from said through-hole to said lower end of said head body, said upper bore being defined by a bore-defining wall that defines a first abutting face transverse to the length of said through-hole;

a first striking body mounted detachably on said lower end of said head body and having a striking portion and a connecting portion that extends from said striking portion, that is received fittingly in said lower bore in said head body, and that is formed with an inner thread; and a stress-distributable fastener including a connecting rod that extends fittingly through said through-hole and said upper and lower bores in said head body and that has a threaded lower end which engages threadedly said inner thread of said connecting portion of said first striking body, and an upper end which is opposite to said threaded lower end and which is formed with an abutting flange extending radially and outwardly therefrom, said abutting flange being received fittingly in said upper bore, and defining a second abutting face that is anchored on and that abuts against said first abutting face of said bore-defining wall of said upper bore upon tightening of said threaded lower end of said connecting rod onto said inner thread of said connecting portion of said first striking body so as to distribute stress, which results from a hammering operation, to said abutting flange, and so as to prevent concentration of the stress on said threaded lower end of said connecting rod and loosening of said first striking body from said head body.

2. The striking head-interchangeable hammer of claim 1, further comprising a second striking body that is disposed opposite to said first striking body, and that is integrally formed with and that extends from said abutting flange of said stress-distributable fastener.

3. The striking head-interchangeable hammer of claim 2, further comprising a third striking body that is mounted detachably on said handle, and that is interchangeable with said first striking body for mounting on said head body.

4. The striking head-interchangeable hammer of claim 1, wherein said lower bore in said head body is defined by a bore-defining wall that defines a base face opposite to said first abutting face of said bore-defining wall of said upper bore, said head body being formed with a positioning pin that protrudes from said base face into said lower bore, said connecting portion of said first striking body being formed with a pin hole that receives fittingly said positioning pin therein.

5. The striking head-interchangeable hammer of claim 1, wherein said handle includes a first tubular member that is connected securely to said head body, and a second tubular member that has a socket end extending into and connected securely and detachably to said first tubular member, said striking head-interchangeable hammer further comprising a screw-driving bit with a non-circular connecting end that is snugly fitted in said socket end of said second tubular member, and a driving end that is opposite to said connecting end and that extends into said first tubular member when said first and second tubular members are assembled together.

6. The striking head-interchangeable hammer of claim 5, wherein said second tubular member defines an inner space therein, said striking head-interchangeable hammer further comprising an elongated bit-positioning member that is received in said second tubular member and that includes a central rod and a plurality of angularly displaced partitioning fins extending radially from said central rod so as to divide said inner space into a plurality of partitions that are adapted to receive tool bits, respectively.

7. The striking head-interchangeable hammer of claim 1, wherein the upper bore has a larger diameter than the through hole and wherein the lower bore has a larger diameter than the through hole.

* * * * *